United States Patent [19]

Mikus

[11] Patent Number: 5,052,142

[45] Date of Patent: Oct. 1, 1991

[54] SAFETY LOCK FOR REVOLVERS

[76] Inventor: Edward M. Mikus, 3123 Zarieda, Metamora, Mich. 48455

[21] Appl. No.: 553,824

[22] Filed: Jul. 16, 1990

[51] Int. Cl.[5] ..... F41A 17/02

[52] U.S. Cl. ..... 42/70.11

[58] Field of Search ..... 42/66, 70.11

[56] References Cited

U.S. PATENT DOCUMENTS

| | | | |
|---|---|---|---|
| 2,803,909 | 8/1957 | Soski et al. | 42/66 |
| 2,943,411 | 7/1960 | Salva | 42/70.11 |
| 3,022,598 | 2/1962 | Wikstrom | 42/70.11 |
| 3,027,674 | 4/1962 | Mahan | 42/66 |
| 3,085,360 | 4/1963 | Robbins et al. | 42/70.11 |
| 3,208,176 | 9/1965 | Giles | 42/70.11 |
| 3,360,880 | 1/1968 | Finnegan | 42/70.11 |
| 3,378,943 | 4/1968 | Valburg | 42/70.11 |
| 4,048,741 | 9/1977 | Chiodo et al. | 42/70.11 |
| 4,092,794 | 6/1978 | Moren | 42/70.11 |
| 4,802,298 | 2/1989 | Baugus | 42/70.11 |
| 4,827,649 | 5/1989 | Sheehan | 42/70.11 |

*Primary Examiner*—Charles T. Jordan

*Attorney, Agent, or Firm*—Dykema Gossett

[57] ABSTRACT

There is disclosed a safety device for a firearm in the form of a cartridge insertable within the chamber of a revolver, rifle or the like such that when the particular opening in the firing chamber of the firearm is aligned with the barrel, a plunger will extend from a cartridge-like casing into the barrel and thus block the firing of the firearm. The safety device disclosed to accomplish this purpose is in the nature of a cartridge having a plunger mounted for reciprocal movement therein by a cam and follower-type mechanism such as found in the common ballpoint pen.

8 Claims, 3 Drawing Sheets

SAFETY LOCK FOR REVOLVERS

BACKGROUND OF THE INVENTION

1. Field of the Invention

The present invention relates to safety devices for firearms, and more particularly to an improved safety device usable in the firing chamber of rifles, pistols and the like to prevent operation by unauthorized personnel.

2. Description of the Prior Art

During a life-long career in law enforcement, I have had the saddening experience of observing many accidents with firearms due to person's other than the owner handling the gun in the owner's absence. While most firearms are equipped with safety devices, such as safety catches and the like, these are external, and when observed by the unauthorized user of the firearm, can easily be disengaged, allowing the firearm to be fired by the user and in many cases causing injury due to unexpired shells still being present in the firearm.

In order to solve the problem of these injuries occurring, it has occurred to me and to others to have a concealed safety device for use in firearms which would be undetectable by the unauthorized user of the firearm, but easily inserted and activated by the owner thereof to prevent unnecessary injury. In my attempt at arriving at a solution to the problems of injury caused by unauthorized use of firearms, I determined that the easiest way to provide such a safety device was to have a casing of a size insertable into the firing chamber of the firearm and have a plunger which can be extended by the owner into the barrel of the firearm, but still be undetectable by the user. There are many such devices on the market, such as those listed below which were located during a patentability search made through the records of the Patent and Trademark Office.

| DATE OF PATENT | PATENTEE | U.S. PAT. NO. |
|---|---|---|
| August 27, 1957 | W. H. Soski, et al. | 2,803,909 |
| July 5, 1960 | J. Salva | 2,943,411 |
| February 27, 1962 | H. M. Wikstrom | 3,022,598 |
| April 3, 1962 | J. F. Mahan | 3,027,674 |
| April 16, 1963 | L. C. Robbins, et al. | 3,085,360 |
| September 28, 1965 | J. E. Giles | 3,208,176 |
| January 2, 1968 | T. J. Finnegan | 3,360,880 |
| April 23, 1968 | R. Valburg | 3,378,943 |
| June 6, 1978 | Moren | 4,092,794 |
| February 7, 1989 | D. G. Baugus | 4,802,298 |
| May 9, 1989 | M. J. Sheehan | 4,827,649 |

A study of these patents shows that other inventors have taken many of the steps I took before I arrived at the present invention, but did not go far enough in making a convenient safety device, so that it is believed that many of these devices, because of their inconvenient nature, go unused by the firearm owner after a short while. I, myself, in arriving at the present invention, went through several stages of development, such as having the twisting mechanism disclosed in U.S. Pat. No. 3,360,880 to T.J. Finnegan, a sliding-type plunger such as disclosed in U.S. Pat. No. 3,378,943 to R. Valburg, and the screwdriver-type device in U.S. Pat. No. 4,092,794 to Moren.

However, as stated above, after a short while, all of these proved to be too difficult to operate because of the need for a special tool, and I next tried a solution to the problem similar to that disclosed in U.S. Pat. No. 3,027,674 to J.F. Mahan of having a casing insertable in a revolver chamber with a spring-loaded plunger. However, even this proved to be too difficult to operate as one had to keep the spring-loaded plunger depressed while trying to close the revolver cylinder, and in removing the device from the cylinder, one had to keep the plunger depressed with the rod while again opening the cylinder. I was determined to arrive at a better solution to the problem.

SUMMARY OF THE INVENTION

After much experimentation, I arrived at a method of keeping the plunger retracted into the casing while inserting and removing the cartridge from the firing chamber of the firearm. I did this after much experimentation by taking the common cam and follower type mechanism which operates the common ball point type pen and adapting it for use in my safety lock by providing grooves similar to those found on the inside of a ball point pen on the inside of the casing and providing the necessary mechanism to extend and retract the plunger like the top of a ball point pen extends and retracts.

Therefore, it is an object of the present invention to provide an improved safety device for firearms of all types, such safety device being designed to provide positive locking against accidental or unauthorized use of the firearm.

A further object of the present invention is to provide a cartridge-type safety device easily placed in the firing chamber of a wide variety of firearms to prevent movement of the firing chamber with respect to the barrel when the safety device is in its operative condition.

A further object of the present invention is to provide a cartridge-type safety device for revolvers wherein the cartridge may be inserted in the barrel of the revolver, with the plunger remaining retracted while the revolver cylinder is closed, and then the plunger being extended by external means after it is in line with the barrel of the revolver.

A still further object of the present invention is to provide a cartridge-type safety device for firearms having a plunger movable from a retracted position to an extended position when desired by the operator.

A further object of the present invention is to provide a safety device of the foregoing nature wherein the plunger is operated by a ballpoint pen-type pen mechanism.

Further objects and advantages of the present invention will become apparent with reference to the appended drawings wherein like characters represent like parts in the several views. Also, it is to be understood that the phraseology and terminology used herein is for the purpose of description, and not of limitation.

DESCRIPTION OF THE PREFERRED EMBODIMENTS

Figure 1:
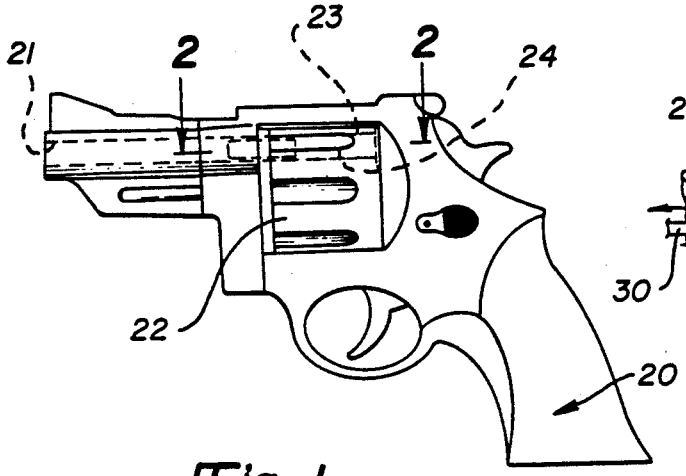
FIG. 1 is an elevational view of a typical handgun, having the barrel thereof and one of the firing chambers shown in dotted lines, with my invention installed in said chamber and also shown in dotted lines.

Although my safety device is usable in a wide range of firearms, such as rifles, revolvers and the like, and in fact can be used in any firearm wherein the extension of the plunger of my safety device will prevent firing of the firearm, for ease of explanation, I am describing the preferred embodiment of my invention with regard to the common ordinary handgun or revolver, generally designated by the numeral 20, as shown in FIG. 1. Such a revolver will have a barrel 21 and a revolving cylinder 22, with a plurality of chambers 23. The safety device, generally designated by the numeral 24, is designed to be inserted in its retracted position into one of the chambers 23 while cylinder 22 is open, and be subsequently placed in its operative position to engage a portion of the barrel 21, thereby preventing the operation of the revolver by preventing the operation of the cylinder which, as is well known in the art, will prevent the handgun from operating.

Figure 2:
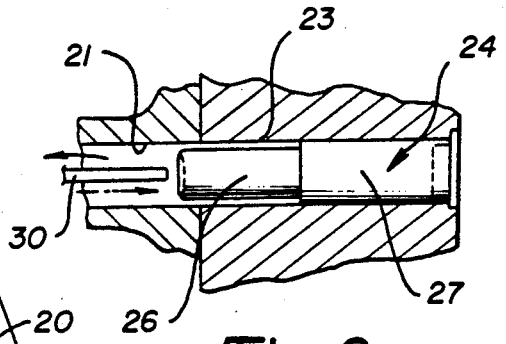
FIG. 2 is a sectional view, taken in the direction of arrows, along the section line 2—2 of FIG. 1.
Figure 3:
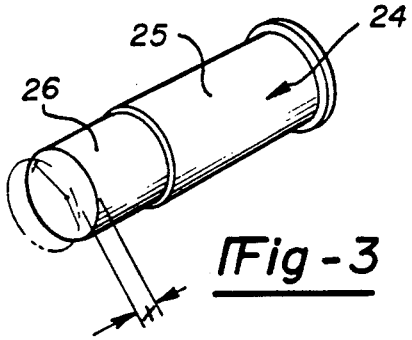
FIG. 3 is a perspective view of the safety device of the present invention showing the plunger in its retracted position in solid lines, and in its extended position in dotted lines, to show the length of travel of the plunger between its extended and retracted positions.

As shown in FIG. 3, my improved safety device generally consists of a casing 25 and a retractable plunger 26 which moves between a retracted and extended position upon operation by the owner of the firearm. It is important to note that the plunger does not have to travel very far, only a short distance X to engage the barrel 21 of the firearm 20 to prevent its rotation. This can be seen in more detail by referring to FIGS. 2 and 4, which show in an enlarged section the barrel 21 of the revolver 20 with one of the firing chambers 23 having my improved safety device 24 mounted therein and the chamber 23 being in line with the barrel 21.

Figure 4:
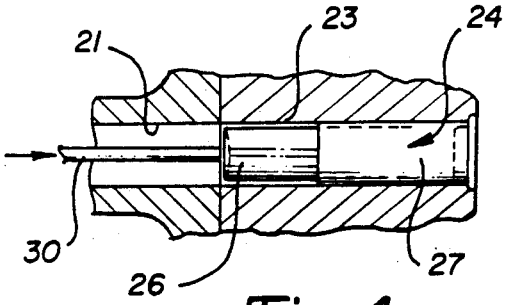
FIG. 4 is a view in large part similar to FIG. 2 showing the operator having inserted a rod and being about to operate the plunger to extend it to the position shown in FIG. 2.

Referring now to FIG. 4, my safety device 24 is shown having the plunger 26 in its retracted position and being installed in one of the chambers 23 of the revolver 20, which is in alignment with the barrel 21 thereof. The operator is just about to extend the plunger 26 by the use of the rod 30.

As seen in FIG. 2, the operator, by slightly depressing the plunger 26, has caused operation of the plunger extension and retraction means which, in the preferred embodiment of the invention, is a cam and follower-type mechanism which may be of the type found in the common ballpoint pen and which for ease of explanation I will refer to as a "ballpoint pen-type mechanism." It should be understood that a wide variety of cam and follower mechanisms may be used to cause the operation of the plunger in the present invention and still achieve the purposes of my invention, as long as the plunger remains in its extended or retracted position, as desired by the operator, once it is placed in such position. I have chosen a "ballpoint pen-type" mechanism because it is widely known and accomplishes the intended function in an efficient and low-cost manner.

Figure 5:
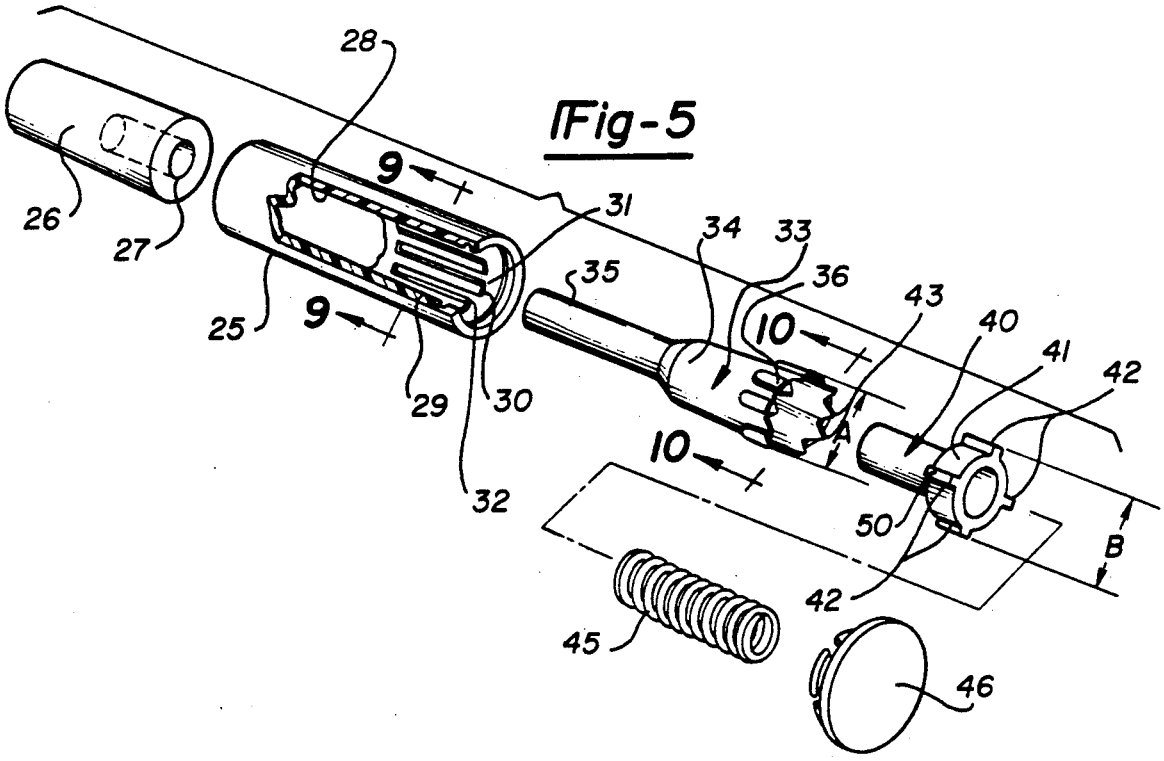
FIG. 5 is an exploded assembly view of a construction embodying the present invention.
Figure 6:
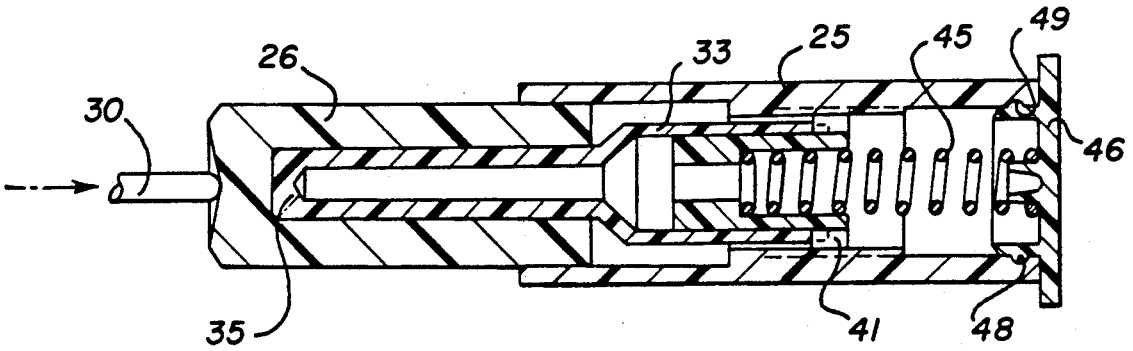
FIG. 6 is an elevational view of the device shown in FIG. 3 with the plunger in the extended position.
Figure 7:
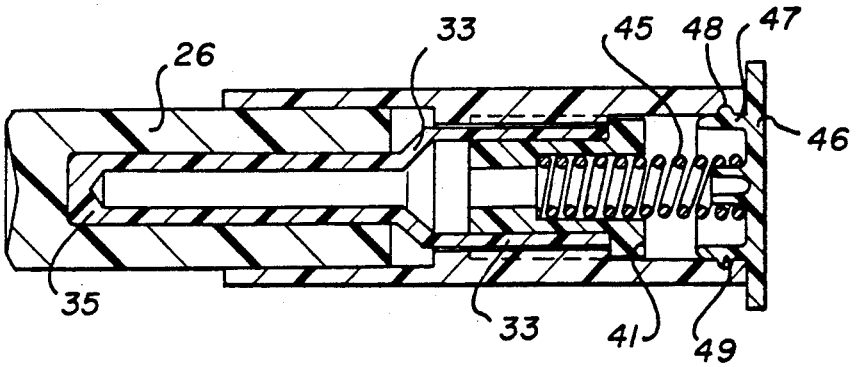
FIG. 7 is an elevational view showing the construction of FIG. 6 with the plunger in the retracted position.
Figure 8A:
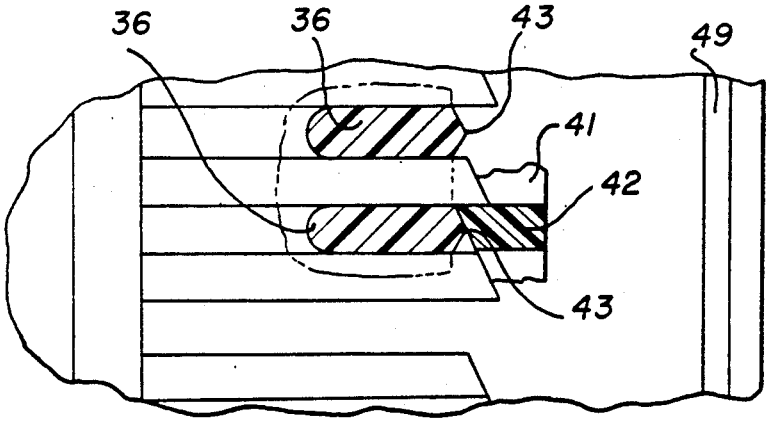
FIGS. 8A–8C are enlarged views showing the operation of the ballpoint pen-type cam and follower mechanism of the present invention which operates to extend the plunger from its extended to retracted positions and back, while keeping said plunger in either the extended or retracted position without further need for assistance by the operator of the firearm.
Figure 8B:
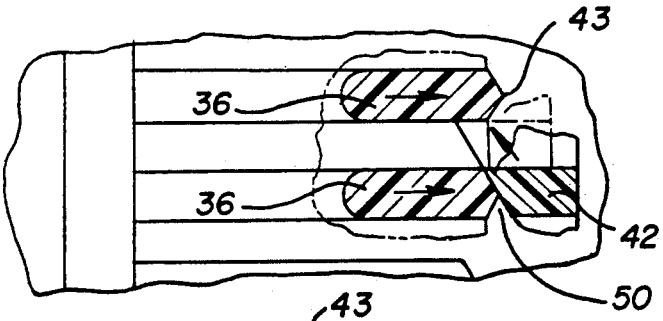
Figure 8C:
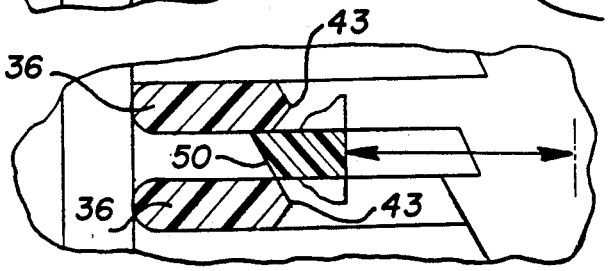
Figure 9:
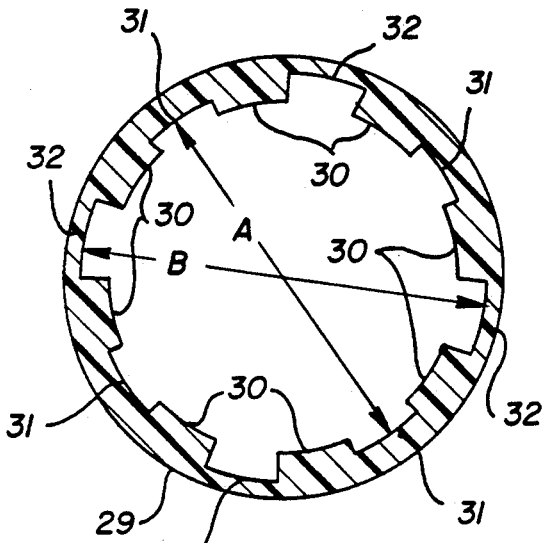
FIG. 9 is a sectional view, taken in the direction of the arrows along the section line 9—9 of FIG. 5.

Referring to FIG. 5, there is an exploded view showing how I have applied the ballpoint pen mechanism to operate the plunger of my device. As can be seen, I have used the ballpoint pen mechanism somewhat in reverse, as I am concerned with the operation of what could be called the plunger, rather the ballpoint pen cartridge, and certain modifications have been needed. The casing 25 has a plunger-receiving portion 28 into which the plunger 26 fits in a slidable relationship, preferably with some friction between the walls of the plunger 26 and the casing 25 for purposes to be explained hereinafter. One end of the plunger 26 has a recess 27 for purposes to be described. At the other end of the casing 25 from the plunger-receiving portion is a slotted portion 29 having a plurality of slots terminating in first cam surface 30. By referring to FIG. 9, it can be seen that the depths of the slots are of two different types. There are a predetermined number of shallow slots 31 and an equal number of deep slots 32. In the common ballpoint pen-type mechanism, there are four shallow slots and four deep slots. The reason for this will become evident from the following brief explanation of the operation of a ballpoint pen-type mechanism as adapted to the present invention.

Figure 10:
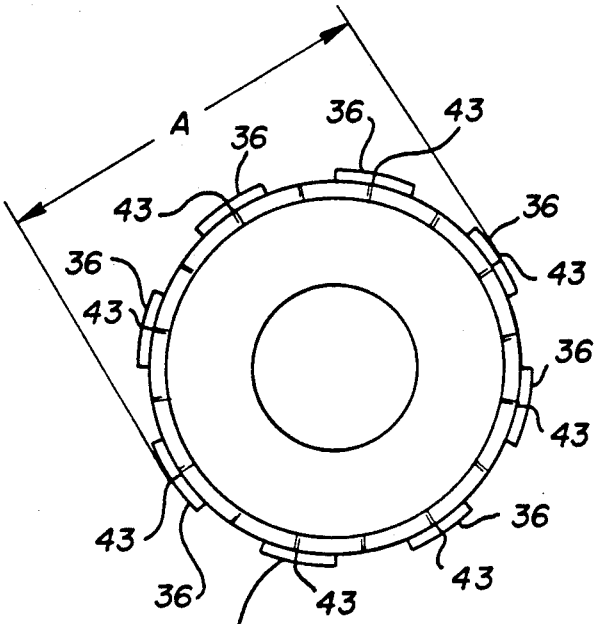
FIG. 10 is a sectional view, taken in the direction of the arrows along the section line 10—10 of FIG. 5.

In order to operate the plunger 26 in a reciprocal manner within the casing 25, there is first provided a plunger extension member 33 having a barrel portion 34 and an extension portion 35. It can be seen that the extension portion fits into the recess 27 in the plunger 26. The barrel portion 34 of the plunger extension member 33 has a plurality of radially extending projections of outside diameter A, as shown in FIG. 10, which will allow the plunger extension member 33 to move up and down in a reciprocal manner in the shallow slots 31 and the deep slots 32, because of the virtue of it being of a minor diameter A, rather than the major diameter B, shown in FIG. 9. Thus, the plunger extension member 33 does not rotate as it reciprocates and will reciprocate regardless of how it is inserted in the slotted portion of the casing 25. This is not true for the plunger control member 40 which has an enlarged portion 41 having a number of ridges 42 thereon, one-half in number of the projections 36. Also, the ridges 42 are of major diameter B, such that they can only travel up and down in the deep slots 32 and will not move downward in the shallow slots 31.

Because of the wedge shape 50 of the forward end of the ridges 42 and because the plunger control member 41 is biased toward the pointed cam surfaces 43 on the projections 36 by the spring 45, which is held in place by the snap closure 46, each time the operator depresses plunger 26, the plunger extension member 33 is forced downwardly in the slots 31, 32, the ridges 42 temporarily leave the deep slots 32 and rotate a portion of a revolution and come to a stop against the cam surface 30 of the casing 25 because they cannot travel downwardly in the slot 31 because of interference between the ridges which are of a diameter B and the shallow slots which are of a diameter A. Thus, the plunger control member stays at the bottom of the casing 25, and because of the friction of the plunger 26 against the plunger-receiving portion 28 and the friction between the recess 27 and the extension portion 36 of the plunger extension member 33, the plunger 26 stays in its retracted position until the operator again slightly depresses the plunger which causes the plunger control member 40 to again make a portion of a revolution, at which time it can travel upwardly in the deep slots 32 propelled by the spring 45 to extend the plunger 26.

Figure 11:
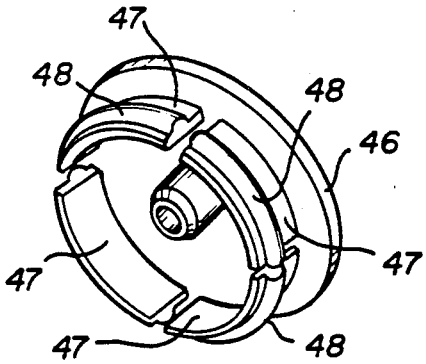
FIG. 11 is a perspective view of the closure member which closes the lower end of the casing in the preferred embodiment of the present invention.

For ease of assembly, I choose to use a snap closure 46 to close the end of the casing 25, although any practicable closure means may be used. Referring to FIG. 11, there is shown closure member 46 having a plurality of flexible upstanding projections 47 each of which has a beaded portion 48. When inserted into the bottom portion of the casing 25 the upstanding portions 47 will flex inwardly slightly allowing the beaded portions 48 to engage the slot 49 and thereby close the end of the casing 25.

Thus, by taking the well-known ballpoint pen mechanism and adapting it for use in a safety device for a revolver, by essentially using said ballpoint mechanism in reverse, I have come up with a novel safety device which is convenient for the user, is internal in nature, and has solved many longstanding problems in the art.

I claim:

1. A safety device for a firearm operable from a closed to an open position which, when in its open position, prevents operation of said firearm, said safety device including:

(a) a hollow casing having a plunger receiving portion and an extension member receiving portion, (b) a plunger mounted for reciprocal movement in said plunger-receiving portion, (c) a plunger extension member operatively connected to said plunger to move said plunger from a retracted to an extended position, (d) a plunger control member, (e) a closure member, and (f) spring-biasing means interposed between said closure member and said plunger extension control member.

2. The device defined in claim 1, wherein said plunger extension member has an upper extension portion and a barrel portion separated by a bevel portion, said barrel portion having a plurality of radially spaced cam followers cooperating with mating cam surfaces provided in said plunger-receiving portion of said plunger of said hollow casing, the upper surfaces of said cam followers having a second cam surface, said extension portion fitting into a recess of said plunger.

3. The device defined in claim 2, wherein said plunger control member fits in a recess in said plunger extension member and has a plurality of second cam followers radially spaced about the lower periphery thereof cooperating with said second cam surfaces to rotate said plunger control member each time said plunger is depressed.

4. The device defined in claim 3, wherein the diameter of said plunger control member across said second cam followers is greater than the diameter of said plunger extension member measured across said first cam followers, the diameter of said second cam followers being equal to the major diameter of the interior of said extension member receiving portion of said casing and the diameter measured across the first cam followers of said plunger extension member being equal to the minor diameter of the interior of said plunger-receiving portion.

5. The device defined in claim 4, wherein said closure member for closing the lower extremity of said casing is a snap-in member.

6. The device defined in claim 5, wherein said plunger is fixedly attached to said extension portion of said plunger extension member.

7. A safety device for a firearm of the revolver type having a barrel and a rotating cylinder, said safety device operable from a closed to an open position, which when in its open position prevents operation of said firearm by having a plunger extending from said safety device into the barrel of said firearm, said safety device including:

(a) a hollow casing, (b) a plunger mounted in said hollow casing for reciprocal movement, and (c) a spring loaded cam and follower mechanism which keeps said plunger in a fully extended or a fully retracted position, and is changeable from said fully extended to said fully retracted position, and visa versa, by depressing said plunger.

8. A safety device for a firearm, said safety device operable from a closed position to an open position, said safety device when in its open position preventing operation of said firearm, said safety device including:

(a) a hollow casing portion, (b) a plunger portion mounted in said hollow casing for reciprocal movement therein, and (c) a spring loaded cam and follower mechanism which keeps said plunger either in a fully extended or a fully retracted position, said plunger being changeable between said fully extended and said fully retracted position by depressing and releasing said plunger.

* * * * *